United States Patent [19]

Lammertink

[11] Patent Number: 4,871,173

[45] Date of Patent: Oct. 3, 1989

[54] PUZZLE OR GAME HAVING TOKEN FILLED TRACK AND TURNTABLE

[75] Inventor: Ferdinand Lammertink, Holland, Netherlands

[73] Assignee: Binary Arts Corporation, Alexandria, Va.

[21] Appl. No.: 239,684

[22] Filed: Sep. 2, 1988

[51] Int. Cl.[4] ..... A63F 9/08

[52] U.S. Cl. ..... 273/153 S

[58] Field of Search ..... 273/153 S

[56] References Cited

U.S. PATENT DOCUMENTS

| | | | |
|---|---|---|---|
| 332,211 | 12/1885 | Protheroe | 273/153 S |
| 753,266 | 3/1904 | Hubbard | 273/153 S |
| 4,452,454 | 6/1984 | Greene | 273/153 S |

FOREIGN PATENT DOCUMENTS

| | | | |
|---|---|---|---|
| 48795 | 4/1982 | European Pat. Off. | 273/153 S |
| 1217445 | 3/1986 | U.S.S.R. | 273/153 S |

*Primary Examiner*—Anton O. Oechsle

*Attorney, Agent, or Firm*—Oblon, Spivak, McClelland, Maier & Neustadt

[57] ABSTRACT

An amusement device includes an endless track containing a plurality of indicia bearing tokens independently movable in the track and filling the track. A first portion of the track is part of a turntable which permits the first portion to be rotated relative to the remainder of the track such that the order of the tokens in the first portion is reversed. The first portion of the track has a length relative to the sizes of the tokens such that at least two of the tokens are positioned in the first portion at any time.

6 Claims, 1 Drawing Sheet

PUZZLE OR GAME HAVING TOKEN FILLED TRACK AND TURNTABLE

BACKGROUND OF THE INVENTION

1. Field of the Invention:

The present invention relates generally to puzzles and amusement devices. More specifically, the present invention relates to a manipulative puzzle or amusement device which incorporates pieces which are shiftable or transferrable in an interrelated manner.

2. Description of the Prior Art:

Manipulative puzzles whose object is to arrange characters or color patterns into a particular order have enjoyed popularity for centuries.

A recent well known example is the Rubik's Cube, which employed a design for scrambling and rearranging colored squares across the faces of a three dimensional cube.

The "Fifteen Puzzle" of Sam Lloyd is another example of a manipulative puzzle which has been popular for generations. Invented in the late 19th century, this is a puzzle functioning in two dimensions: it consists of a square tray containing fifteen square tiles, each bearing a different number, from 1 to 15 inclusive. The geometry of fifteen square tiles in a grid creates a single open space within the tray, which permits the tiles to be shifted within the tray without lifting them. The object of the puzzle is to move the tiles into a position such that the numbers represented on the tile face are in proper order, running in sequence from 1 to 15 starting at the upper left corner and proceeding across each row in turn, leaving the open space in the lower right corner. In order to begin the puzzle, depending on the initial configuration the player may either be required to scramble the numbers to create a random pattern, or the puzzle may be delivered to the player in a pre-arranged scrambled pattern with the object that the player must set the numbers in order beginning with the prearranged scrambled pattern.

One significant property of the "Fifteen Puzzle" is that it is not possible to move the square tiles from their initial configuration to any and all other configurations: because of the mathematical principles governing the movement of the tiles in relation to each other, some combinations are not possible. Thus, from its inception, an integral component of the "Fifteen Puzzle" was the mathematical relationships among the square tiles, which allowed or did not allow particular sequences of numbers to be accomplished.

A third example of manipulative pattern puzzles, which Applicant believes are most similar to the current invention, belong to class of puzzles called "Shunting Puzzles". Puzzles of this type can be generally characterized as having a series of blocks arranged in a linear fashion, with an alphanumeric character or other indicia distinguishing one block from another, arranged on a track so that the blocks may slide along the track. The track is designed in such a way that blocks may be moved to change the relative relationships with each other, thereby accomplishing the object of these puzzles. Typical mechanisms to allow the blocks to change relative positions include circular turntables in the tracks, and "sidespur" sections of track to park individual blocks or groups of blocks while other blocks were being manipulated. These puzzles appear to have been most popular in the late 19th century, when railroads were at their height and there was much interest in efficient movement of trains within the confines of limited track capacity.

Within the category of "Shunting Puzzles", there are several which use circular turntable mechanisms. One of these is shown in U.S. Pat. No. 753,266 to Hubbard. This puzzle consists of two sets of blocks set into a linear track and separated by a circular turntable capable of holding two blocks at a time. Each block is distinguished from the others by an alpha-numeric or other indicia; the object of the puzzle is to reverse the sequence of blocks by the proper manipulation of the blocks within the turntable.

A more general puzzle utilizing a turntable mechanism is shown in U.S. Pat. No. 332,211 to Protheroe. This puzzle consists of a linear train of blocks each with a distinguishing indicium, held together by a rod extending from one end to the other, and which can slide along a linear track. Situated in the center of the track is a turntable which allows the reversal of a definite number of blocks within the train. The intent of the puzzle is for the player to start with a sequence of blocks in order—his example is for the blocks to spell out the words "Humpty Dumpty"—and then to randomize the sequence by a series of moves of the train back and forth, and by turning the turntable. The object would then be to recreate the original order.

U.S. Pat. No. 332,211 also contemplates several variations of the basic puzzle. These include a puzzle with two tracks set perpendicularly to one another and the turntable positioned at the junction of the two tracks, and a puzzle consisting of one or more bounded trains of blocks situated an endless circular track with multiple turntables.

SUMMARY OF THE INVENTION

It is an object of the present invention to provide an amusement device such as a puzzle or game having an endless track, a portion of which forms a turntable.

It is a further object of the invention to provide an amusement device having an endless track, a portion of which comprises a turntable, the track being completely filled with independently movable indicia bearing tokens.

It is yet a further object of the invention to provide an amusement device having an endless track, a portion of which comprises a turntable, which is completely filed with independently movable indicia bearing tokens, in which the ratio of the number of tokens in the track to the number of tokens in the turntable provides a maximum diversity of game possibilities having possible solutions.

The amusement device of the present invention satisfies the above objects by comprising means forming an endless track, means defining a plurality of indicia bearing tokens which are independently movable in the track and which fill the track, turntable means for rotating a first portion of the track relative to a second portion of the track such that an order of tokens in the first portion may be reversed. The first portion of the track has a length relative to the sizes of the tokens such that at least two of the tokens are positioned in the first portion at any time.

According to a further feature of the invention, the first portion of the track has a length relative to the size of the tokens such that an even number of the tokens are positioned in the first portion at any time and an even number of the tokens are positioned in the track as a whole.

The reference to the tokens filling the track according to the present invention means that the track is filled with tokens by a degree sufficient that the same number of tokens must always be positioned in the turntable when it is turned. Spaces can exist between the tokens within the track, however the sum of the spaces cannot be so great that one can adjust the relative spacing between the tokens to permit a greater or fewer number of tokens to be positioned in the turntable when it is turned, from one turn to the next.

The endless track according to the invention can have any shape including circular, oval or flattened oval, although it cannot have a figure "8" or any other configuration in which portions of the track intersect. The track can be positioned on or in a body having a two dimensional planar surface, can be on a great circle plane of a sphere, can be an outer band of a doughnut shaped three dimensional object or can be mounted on an object of any other shape capable of supporting a closed endless track. Conceivably, the track, turntable and tokens could comprise icons of a video display, such as that of a CRT, in which the position of the icons is controlled with the aid of a suitably programmed computer.

The indicia on the tokens can consist of numerals, alphabetic characters, individually colored surfaces, or any other distinguishable indicia that can be arranged in a desired order.

An important feature of the invention is that the tokens fill the endless loop track. This produces play possibilities which are significantly different from amusement devices in which the track is either linear (bounded), or those in which a continuous loop is not filled with tokens. Devices having a bounded track do not afford the possibility that tokens can be moved from one side of the turntable to the other, without crossing the turntable. Devices in which the track is not filled with tokens provide less complex and interesting game possibilities since one can vary the number of tokens in the turntable.

In contrast, in the device according to the invention each block has two distinct relationships with each other block, one in a clockwise direction and the other in a counterclockwise direction. The mathematical principles controlling the user's ability to manipulate the blocks from one relative relationship to another relative relationship are different and more complex, both in their character and in their result, than those for devices having linear or unfilled tracks.

As an example, consider a game consisting of twenty tokens with a turntable which contains four tokens. Further, consider that the tokens are numbered in the following order: "1,2,3,4,5,6,7,8,10,9,11,12,13,14,15,16,17,18,19,20" with all numbers in order except for the "9" and the "10 ".

The object of the game in this case is to manipulate the tokens back and forth through the turntable, rearranging their order so that the numbers are in proper numerical order.

With a linear (bounded) track and/or a linear (bounded) sequence of tokens having a front and back, this solution could not be obtained. However, with an endless track and unbounded tokens such as described in the present invention, this solution is possible.

One important subclass of puzzles are those puzzles in which any possible configuration of tokens can be attained from any starting point (Objective I). The basic rule for this puzzle is that there must be a series of moves which allow two adjacent tokens to be interchanged without affecting the position of any other token. From this basic shift, it can then be proven that any configuration is possible.

Only certain combinations of a number of tokens in the track as a whole and a number of tokens in the turntable will allow for all combinations. For example, an even number of tokens in the turntable and an even number of total tokens will always allow for any combination of relationships, while in certain cases an even number of tokens in the turntable and an odd number of total tokens in the turntable will not allow the interchange of two adjacent tokens without upsetting the relationships between other tokens on the track.

Another subclass are those puzzles whose object is to manipulate the tokens and turntable in such a way that when the puzzle is finished, the tokens remain in the same order as when they started, but the turntable has been flipped 180 degrees (Objective II). Some puzzles, such as those with an even number of tokens in both the groove and turntable, can always be made to accomplish this, while other combinations having an odd number of either total tokens or tokens in the turntable cannot.

As an example, for a puzzle with seven total tokens and three in the turntable, a basic transposition of two adjacent tokens is possible, so Objective I can be met. However, with this puzzle it is not possible to accomplish a 180 degree flip while returning all tokens to their original order.

Alternatively, for a puzzle with 21 tokens and 5 in the turntable, it is not possible to accomplish the transposition of two blocks, so Objective I cannot be met, but it is possible to flip the turntable without rearranging the order of the tokens (Objective II).

A third subclass are those puzzles whose object is to completely reverse the order of tokens in the track, or "countdown" (Objective III). This could be accomplished, for example, if the tokens started in a position ascending from 1 to 20 in a clockwise fashion around the track, and then were rearranged to ascend in a counterclockwise direction around the track. Certain combinations of tokens in which there are either an odd number of total tokens or an odd number of tokens in the turntable will not permit a solution for Objective III.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Figure 1:
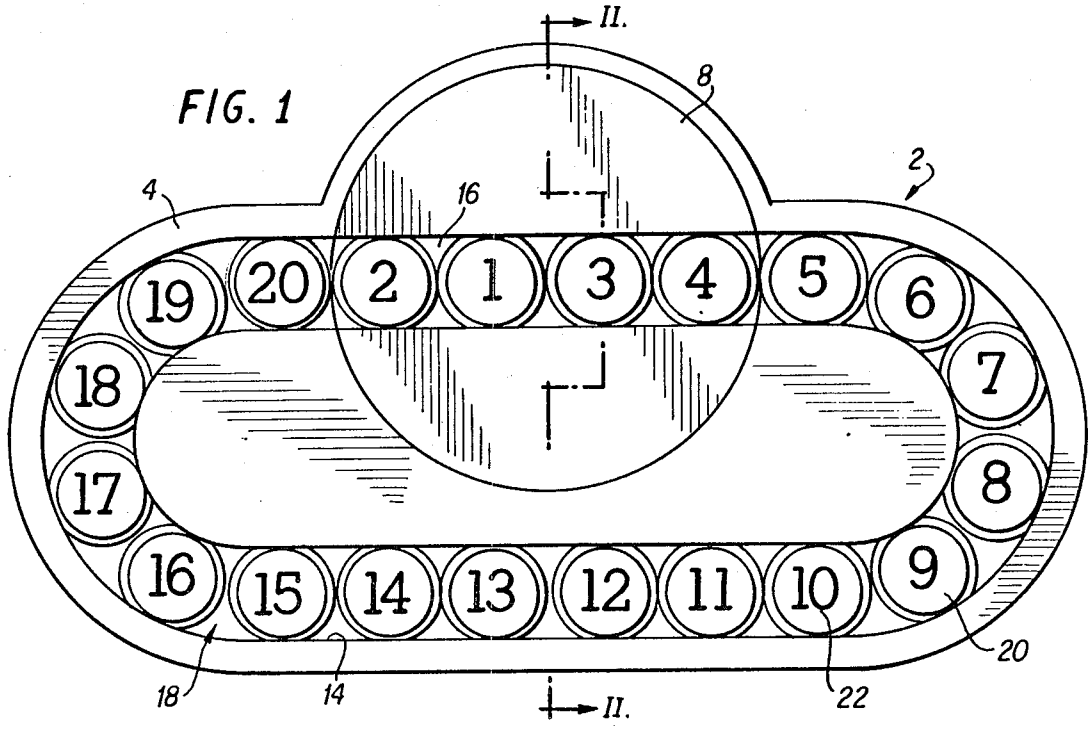
FIG. 1 is a plan view of a puzzle according to the invention.
Figure 2:
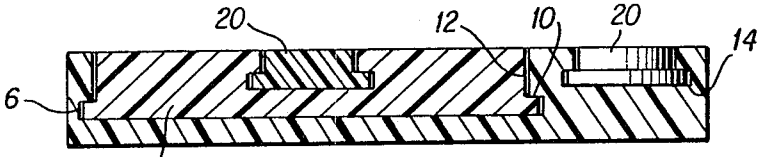
FIG. 2 is a sectional view of the puzzle of FIG. 1, as seen along section II—II.

According to the preferred embodiment, which is not intended to be limiting, a block body 2 has a planar surface 4. A circular groove 6 is formed in the surface 4, within which is placed a circular turntable 8, such that the turntable is able to move about an axis perpendicular to the planar surface 4. In order to permit such rotation, while at the same time preventing the removal of the turntable from the block body 2, a portion of the block body projects into the circular groove 6 as an annular shoulder 10 which fits into an annular recessed portion 12 of the turntable 8.

An elongate groove (second portion) 14 is formed in the block body 2, while a linear groove (first portion) 16 is formed in the turntable 8. The elongate groove 14 and linear groove 16 are relatively positioned such that they together form a continuous or endless track 18 having the form of a flattened oval when the turntable is turned to the positioned shown in FIG. 1. Within this track are positioned a plurality of block-like tokens 20 such that the tokens completely fill the track. Each of the tokens has an indicium 22, such as a numeral, and is held within the track by a shoulder and recess arrangement similar to that used for retaining the turntable 8 within the block body.

According to a preferred feature of the invention, the linear groove 16 (first portion of the track) has a length relative to the sizes of the tokens such that an even number of the tokens are positioned in and fill the first portion at any time, and the entire track 18 has a length relative to the sizes of the tokens that an even number of the tokens are positioned in and fill the entire track. This provide advantages in game playing possibilities.

In general, game playing involves moving the array of tokens around the track until the desired tokens are in the first portion 16 and selectively rotating the turntable 8 by 180° so as to reverse the order of the tokens therein.

Applicant has mathemathetically determined that puzzles meeting all of the previously described three objectives (Objectives I–III) are possible only if they have an endless track with an even number of tokens, including a turntable holding an even number of tokens. Studies were done for the purpose of determining those objectives met various combinations of tokens in the track and turntable. As a result, it was found that combinations of tokens in the track and turntable meeting the various objectives followed a cycle which repeated for multiples of eight tokens. The results of the study are shown in Table 1.

TABLE 1

| | Turntable | | | | | | | |
|---|---|---|---|---|---|---|---|---|
| Track | 8k | 8k + 1 | 8k + 2 | 8k+ 3 | 8k + 4 | 8k + 5 | 8k + 6 | 8k + 7 |
| 8n | TCF | F | TCF | C | TCF | F | TCF | C |
| 8n + 1 | CF | CF | TC | TC | CF | CF | TC | TC |
| 8n + 2 | TCF | CF | TCF | C | TCF | C | TCF | C |
| 8n + 3 | F | F | TC | TC | F | F | TC | TC |
| 8n + 4 | TCF | F | TCF | C | TCF | F | TCF | C |
| 8n + 5 | CF | CF | TC | TC | CF | CF | TC | TC |
| 8n + 6 | TCF | F | TCF | C | TCF | C | TCF | C |
| 8n + 7 | F | F | TC | TC | F | F | TC | TC |

Where n = any integer, but not <k
k = any integer
T = Transposition Exists (Objective I met)
F = Flip inversion exists (Objective II met)
C = Countdown Exists (Objective III met)

Table 1 is applicable to any combination of tokens in the track and turntable, the only constraints being that the number of tokens in the turntable must be a least two and the number of tokens in the track must be greater than that in the turntable. As an example, with four tokens in the turntable (k=0) and 20 in the track (n=2), all three objectives T, C and F are met. However, for 21 tokens in the track (8n+5), only objectives C and F are met.

It can thus be seen from Table 1 that all three puzzle playing objectives can be met only where there an even number of tokens are provided in both the track as a whole, and in the turntable.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An amusement device comprising:

means forming an endless track;

means defining a plurality of indicia bearing token independently movable in said track, said tokens filling said track;

turntable means for rotating a first portion of said track relative to a second portion of said track about an axis substantially perpendicular to the length of said first portion such that an order of tokens in said first portion may be reversed while the position of said first portion relative to the remainder of said track is unaltered, wherein said first portion of said track has a length relative to the sizes of said tokens such that an even number of said tokens are positioned in said first portion at any time, and wherein said track has such a length relative to the sizes of said tokens that an even number of tokes are positioned in and fill said track.

2. The puzzle of claim 1 wherein all of said tokens have the same size in the direction of the length of said track.

3. The puzzle of claim 1 wherein said means forming an endless track comprises a body having a surface, said track comprising an endless groove in said surface.

4. The puzzle of claim 3 wherein said tokens comprise blocks held in said groove.

5. The puzzle of claim 3 wherein said groove is a flattened oval.

6. The puzzle of claim 3 wherein said surface is planar and said turntable means comprise a circular part of said body rotatable about an axis perpendicular to said planar surface, said first portion of said track being formed on said circular part.

* * * * *